US010518919B2

(12) United States Patent
Cheich et al.

(10) Patent No.: US 10,518,919 B2
(45) Date of Patent: Dec. 31, 2019

(54) PACKAGING SYSTEM WITH ADJUSTABLE CONTAINER CLOSER

(71) Applicant: Ranpak Corp., Concord Township, OH (US)

(72) Inventors: Robert C. Cheich, Independence, OH (US); Daniel L. Carlson, Ravenna, OH (US); Kevin W. Park, Chardon, OH (US); Steven M. Toneff, Painesville, OH (US)

(73) Assignee: Ranpak Corp., Concord Township, OH (US)

( * ) Notice: Subject to any disclaimer, the term of this patent is extended or adjusted under 35 U.S.C. 154(b) by 743 days.

(21) Appl. No.: 14/429,231

(22) PCT Filed: Sep. 18, 2013

(86) PCT No.: PCT/US2013/060423
§ 371 (c)(1),
(2) Date: Mar. 18, 2015

(87) PCT Pub. No.: WO2014/047187
PCT Pub. Date: Mar. 27, 2014

(65) Prior Publication Data

US 2015/0210418 A1 Jul. 30, 2015

Related U.S. Application Data

(60) Provisional application No. 61/702,369, filed on Sep. 18, 2012.

(51) Int. Cl.

| | |
|---|---|
| ***B65B 61/22*** | (2006.01) |
| ***B65B 55/20*** | (2006.01) |
| ***B65B 7/28*** | (2006.01) |

(52) U.S. Cl.
CPC ..... *B65B 61/22* (2013.01); *B65B 7/28* (2013.01); *B65B 55/20* (2013.01)

(58) Field of Classification Search
CPC ..... B65B 51/06; B65B 51/067; B65B 55/20; B65B 57/02; B65B 57/10; B65B 59/02
(Continued)

(56) References Cited

U.S. PATENT DOCUMENTS 5,507,907 A * 4/1996 Kropp ..... B65B 51/067 156/350
5,775,053 A 7/1998 Lam
(Continued)

OTHER PUBLICATIONS

International Search Report of corresponding International Application No. PCT/US2013/060423, dated Feb. 11, 2014.
(Continued)

*Primary Examiner* — Andrew M Tecco
*Assistant Examiner* — Nicholas E Igbokwe
(74) *Attorney, Agent, or Firm* — Renner, Otto, Boisselle & Sklar, LLP

(57) ABSTRACT

An improved packaging system (10) includes a packaging line that guides containers in a downstream direction, a sensor (12) that can identify a dimension of a container on the packaging line, a dunnage dispenser (14) on the packaging line downstream of the sensor to dispense dunnage to a void volume in a container, and a container closer (16) downstream of the dunnage dispenser (14) to close containers on the packaging line downstream of the dunnage dispenser. The container closer (16) includes an adjustable member (20), and is in communication with the sensor to (12) adjust the adjustable member (20) based on the identified dimension of the container. The system thus includes a way to identify the size of the container before the container reaches the container closer. The container closer
(Continued)

can adjust for the container's size before the container arrives, speeding up the container closing operation.

12 Claims, 2 Drawing Sheets

(58) Field of Classification Search
USPC ..... 53/467, 500, 503, 504
See application file for complete search history.

(56) References Cited

U.S. PATENT DOCUMENTS

2008/0092488 A1* 4/2008 Gabrielsen ..... B65B 55/20 53/428
2008/0098699 A1* 5/2008 Cheich ..... B31D 5/0047 53/472
2008/0141625 A1* 6/2008 Bilkie ..... B65B 55/20 53/396
2009/0031676 A1* 2/2009 Boigues ..... B65B 5/02 53/491
2009/0173040 A1* 7/2009 Carlson ..... B65B 55/20 53/250
2010/0082159 A1* 4/2010 Kim ..... F25C 5/005 700/275
2011/0016833 A1* 1/2011 Carlson ..... B65B 55/20 53/473
2011/0041464 A1* 2/2011 Park ..... B65B 51/067 53/476
2011/0197550 A1* 8/2011 Carlson ..... B31D 5/0047 53/472
2011/0239596 A1* 10/2011 Thomas ..... B65B 51/067 53/476
2012/0102893 A1* 5/2012 Sambuca, Jr. ..... B65B 51/067 53/476

OTHER PUBLICATIONS

International Preliminary Report on Patentability corresponding to International Application No. PCT/US2013/060423, dated Mar. 24, 2015.

* cited by examiner

PACKAGING SYSTEM WITH ADJUSTABLE CONTAINER CLOSER

FIELD OF THE INVENTION

This invention related generally to a packaging system and method, and more particularly to a packaging system and method using an adjustable container closer.

BACKGROUND OF THE INVENTION

In the process of shipping one or more articles from one location to another, a packer typically places some type of dunnage material in a shipping container, such as a cardboard box, along with the article or articles to be shipped. The dunnage material partially or completely fills the empty space or void volume around the articles in the container. The dunnage material prevents or minimizes movement of the articles that might be damaged during the shipping process. Some commonly used dunnage materials include plastic airbags and converted paper dunnage material.

The dunnage material can be manually or automatically deposited into the container. A common container is a cardboard box with upright flaps that can be folded down to close an open side of the box.

Automated and semi-automated packaging systems typically employ a container closer, sometimes called a case sealer, to close the container after the dunnage material has been placed in the container. Container closers often are adjustable to accommodate different container sizes. Automatically-adjustable container closers typically include a proximity sensor to detect the container and adjust for that container's size. An exemplary container closer is disclosed in U.S. Pat. No. 4,781,786.

SUMMARY OF THE INVENTION

The present invention provides an improvement to automated and semi-automated packaging systems by providing a way to selectively increase dunnage dispensing speed to improve the speed of the packing process for larger void volumes. The present invention also provides a way to identify the size of the container before the container reaches the container closer. Consequently, the container closer can adjust for the container's size before the container arrives, speeding up the container closing operation. The packaging system provided by the invention also can identify containers that do not require a closing operation and adjust to allow the container to pass through or bypass the container closer.

More particularly, the present invention provides a packaging system that includes a packaging line that guides containers in a downstream direction, a sensor that can identify a dimension of a container on the packaging line, a dunnage dispenser on the packaging line downstream of the sensor to dispense dunnage to a void volume in a container, and a container closer downstream of the dunnage dispenser to close containers on the packaging line downstream of the dunnage dispenser. The container closer includes an adjustable member, and is in communication with the sensor to adjust the adjustable member based on the identified dimension of the container.

In one or more embodiments of the invention, the dunnage dispenser is at a dunnage dispensing station along the packaging line, and the dunnage dispenser converters a stock material into a relatively lower density dunnage product.

The present invention also provides a packaging system that includes means for identifying a dimension of a container, means for dispensing dunnage into the container downstream of the identifying means, and means for closing the container downstream of the dispensing means. The dispensing means is in communication with the identifying means and includes an adjustable member that is adjustable based on based on the identified dimension from the identifying means.

In one or more embodiments of the invention, the packaging system has one or more of: (a) the identifying means including a height sensor; (b) the dispensing means including a dunnage conversion machine for converting a stock material into a relatively lower-density dunnage product; and (c) the closing means including a container closer with an adjustable-height member that includes an adhesive applicator.

The present invention also provides a packaging method that includes the following steps: identifying a dimension of a container; dispensing dunnage into the container after the identifying step; adjusting a container closer after the identifying step based on the identified dimension; and closing the container with the container closer after the dispensing step.

The identifying step can include sensing a height dimension of the container. The adjusting step can include adjusting a height of a movable member of the container closer. In an exemplary embodiment, the adjusting step occurs before a container leaves the dunnage dispensing station where the dispensing step occurs.

The present invention also provides a method of dispensing dunnage, comprising the steps of: (a) determining a void volume in a container; (b) if the void volume is less than a predetermined value, dispensing dunnage at a first speed; and (c) if the void volume is greater than the predetermined value, dispensing dunnage at a second speed that is different from the first speed.

Further features of the invention will become apparent from the following detailed description when considered in conjunction with the drawings.

DETAILED DESCRIPTION

Figure 1:
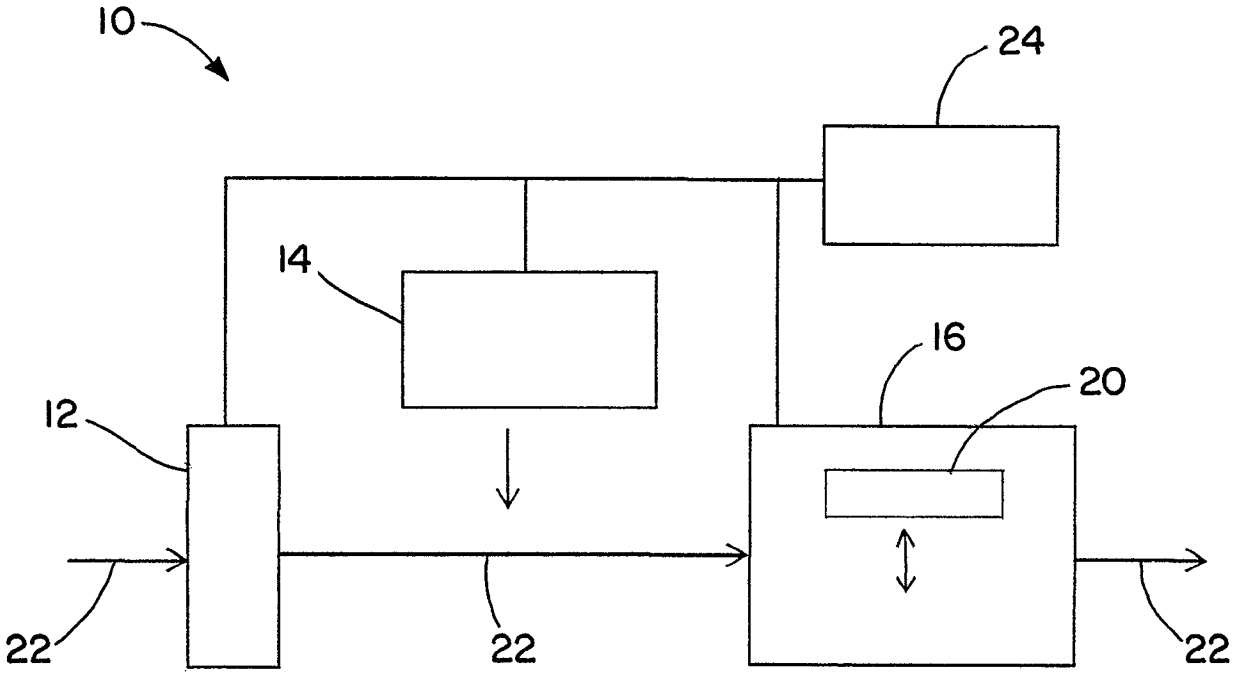
FIG. 1 is a schematic view of a packaging system provided in accordance with the present invention.

Referring now to the drawings in detail, and initially FIG. 1, an exemplary packaging system 10 includes means 12 for identifying a dimension of a container, means 14 for dispensing dunnage into the container downstream of the identifying means 12, and means 16 for closing the container downstream of the dispensing means 14, arranged in series along a packaging line. The closing means 16 is in communication with the identifying means 12 and includes an adjustable member 20 that is adjustable based on the identified dimension from the identifying means 12 to accommodate random container sizes. Containers move through the system in an upstream-to-downstream direction, as shown by arrows 22.

The illustrated system 10 further includes a controller 24 in communication with the identifying means 12, the dispensing means 14, and the closing means 16. The controller 24 generally includes a computer processor or other computational device, a memory, and input and output devices. The controller can be remotely located or integrated into the identifying means 12, the dispensing means 14, or the closing means 16. Alternatively, the functions of the controller can be dispersed to one or more of the identifying means 12, the dispensing means 14, and the closing means 16.

Figure 2:
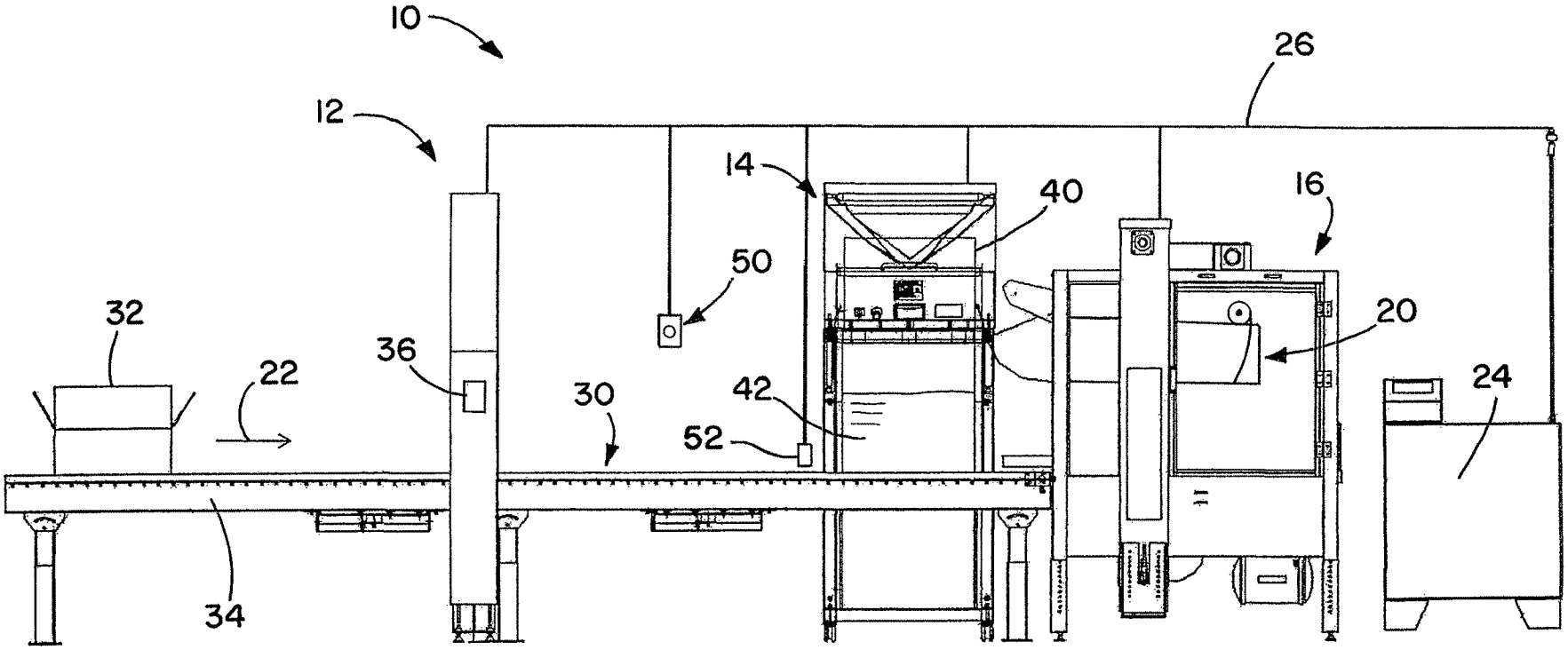
FIG. 2 is an elevation view of an exemplary packaging system provided in accordance with the present invention.

In an exemplary packaging system 10 shown in FIG. 2, the identifying means 12 is a container scanner, the dispensing means 14 is a dunnage dispenser, and the closing means 16 is a container closer with an adjustable-height member 20 that includes an adhesive applicator, for example, a tape applicator. The controller 24 is remotely located and is linked in communication with the scanner 12, the dunnage dispenser 14, the container closer 16, and the packaging line 30 through a wired or wireless communication network 26.

The packaging system 10 also includes a packaging line 30 that guides containers 32 in a downstream direction 22. The packaging line 30 includes a conveyor 34. Sections of the packaging line 30 can be powered or unpowered to control container movement and separation.

The container scanner 12 is the first station on the packaging line 30 and includes a sensor 36 that can identify a dimension of a container 32 on the packaging line 30, such as a height sensor that can identify a height of the container 32 or a bar code sensor or radio frequency device that identify the container 32, its size, or its height. The sensor 36 can include a laser, an ultrasonic device, or any other apparatus for measuring a distance. To further improve the accuracy of the sensor 36 or to use the sensed information to identify a dimension indirectly, the sensed information can be compared to a database of container heights, stored in a memory in the scanner 12 or the controller 24. The dimension identified by the sensor 36 also can be used to determine a void volume in the container 32. An exemplary container scanner is disclosed in U.S. Pat. No. 7,337,595, which is hereby incorporated herein in its entirety. The void volume is the volume of the container that is not otherwise filled by the object or objects being packed in the container. It is this void volume that typically is filled with dunnage to protect those objects during shipment.

The dunnage dispenser 14 is at a dunnage dispensing station along the packaging line 30 downstream of the container scanner 12 and its sensor 36. The dunnage dispenser 14 is in communication with the container scanner 12 and the sensor 36 and is operable to dispense dunnage material to a void volume in a container 32, including dispensing a volume of dunnage material based on the identified dimension of the container 32.

An exemplary dunnage dispenser 14 is shown in the form of a conversion machine 40 for converting a stock material, such as a sheet stock material, for example paper, into a relatively lower-density dunnage product. A supply 42 of stock material, such as the illustrated stack of fan-folded paper, a sheet stock material, is provided for the conversion machine 40 in the illustrated embodiment. An exemplary dunnage conversion machine is shown in U.S. Pat. No. 7,186,208, which is hereby incorporated herein in its entirety.

The dunnage dispenser 14 generally can be controlled to dispense or output dunnage through a range of speeds without compromising the quality or desired characteristics of the dunnage being supplied. In addition, if the dunnage is supplied too rapidly, an operator may not have sufficient time to direct the dunnage into the container. If the dunnage is dispensed faster than the operator can direct it into the container, and all the spaces in the void volume need to be filled, the faster dispensing speed will not reduce the amount of time needed for the packer to pack the container. Accordingly, there is a limit to how fast the dunnage can be dispensed as a way of minimizing the amount of time required to pack the container. Moreover, while the quality of the dunnage produced by a dunnage converter-type of dunnage dispenser 14 generally is adequate over a range of dispensing speeds, a slower dispensing speed may provide different packaging qualities and characteristics in comparison to the dunnage produced at a higher speed. The different qualities and characteristics of dunnage produced at different speeds may be more desirable in particular situations. Accordingly, there may be situations where a lower dunnage dispensing speed is desirable both for the characteristics of the dunnage product produced and for the convenience of the packer. Where possible, however, a higher dispensing speed can be used to reduce the overall packing time.

To improve the speed of the packaging line and reduce the time required for the packing process, the present invention also provides a way to control the dunnage dispenser 14 as a function of the size of the void volume measured by the container scanner 12. Specifically, if the void volume equals or exceeds a predetermined value, the rate at which the dunnage dispenser 14 dispenses dunnage is increased. In other words, the rate at which the dunnage dispenser 14 dispenses dunnage is a function of the measured void volume.

For example, if a container with a void volume of 56,633 cubic centimeters (two cubic feet), a standard rate of fill of 139.7 cm per second (55 inches per second) and a fill ratio of about 16,000 centimeters per cubic meter (15 linear feet per cubic foot) are used, it will take approximately 6 seconds to fill the void volume in the container. If this void volume is above a predetermined value, such as 50,000 cubic centimeters, the rate of fill can be increased to about 280 centimeters per second (110 inches per second) and the fill time reduced to 3.5 seconds.

The faster speed generally is only a significant advantage in conjunction with larger void volumes. A smaller void volume would not benefit as much from an increased dispensing or output rate, and a slower dispensing rate makes it easier for a packer to secure the dunnage in the container. So a slower dispensing rate can be used with smaller void volumes to make it easier for the packer to pack the container, without significantly increasing the packing time. The analysis of the void volume relative to the predetermined value or values established for changing the speed of the dunnage output can be done in the controller 24, or any logic device in the container scanner 12 or in the dunnage dispenser 14, to reducing the amount of time the container remains at the dunnage dispenser 14.

The container closer 16 is downstream of the dunnage dispenser 14 and is operable to close containers 32 on the packaging line 30 downstream of the dunnage dispenser 14 after dunnage material has been deposited into the container 32. In the case of a standard container with multiple upright flaps, the container closer 16 folds the flaps inwardly to a substantially horizontal orientation and then seals the flaps in place. The container closer 16 includes an adjustable member 20, typically a height-adjustable member. The communication network 26 provides a communication link between the container scanner 12 and the sensor 36, and the container closer 16. This allows the container closer 16 to adjust the adjustable member 20 based on the identified dimension, facilitating use of the container scanner with random sizes of containers. The container scanner 12 is adjustable, and more particularly the adjustable member 20 is movable, to accommodate containers 32 with different heights, but also can adjust for containers having different widths as well. The adjustable member 20 includes an adhesive applicator, such as a tape applicator, to seal containers closed.

The present invention also provides a packaging method which can be described in conjunction with the operation of the system 10 shown in FIG. 2. The method includes the steps of using the scanner 12 for identifying a dimension of a container 32, using the dunnage dispenser 14 for dispensing dunnage into the container 32 after the identifying step, adjusting the container closer 16 after the identifying step based on the identified dimension by moving the adjustable member 20, and closing the container 32 with the container closer 16 after the dispensing step.

The adjustable member 20 may begin moving to the required position as soon as dunnage material is dispensed to the container, for example. If the container is a non-conforming container, having some type of defect, or being a tote passing along the packaging line (there being no need to close a tote), the adjustable member 20 can be raised to its maximum height to allow the container to pass without being closed. Non-conforming containers, such as damaged containers, overfilled containers, etc., alternatively can be diverted around the container closer 16 for further inspection.

In a semi-automatic system, a packer controls the dispensing of dunnage material, via a switch, for example; and in an automatic system a packer guides the dunnage material into the container but does not control the dispensing of dunnage material. Alternatively, the system may automatically dispense dunnage material to a container at the dunnage dispensing station without any operator involvement In one embodiment, the identifying step includes sensing a height dimension of the container or using the sensed height dimension of a container to determine a container height from a database of container heights, or both. Alternatively, the identifying step can include reading a bar code to identify a container, and then looking up the bar code in a database to identify the height dimension for that container. The identifying step also can include identifying a void volume within the container, and communicating the void volume information to the dunnage dispenser 14.

The adjusting step can include adjusting a height of the movable member 20 of the container closer 16. The adjusting step occurs before a container 32 leaves the dunnage dispensing station where the dispensing step occurs, and can occur simultaneously with the dispensing step.

The system 10 also can include an input device 50 that is remotely located relative to the container closer 16. If a container needs to pass through the container closer 16 without being closed, for example, the input device or remote control 50 can be used to signal that to the container closer 16 or the controller 24. That can cause the movable member 20, such as a taping head, to move to its maximum elevation to allow the container to pass unimpeded. This can be useful if the container is a tote or other container that does not need to be closed but needs to be passed along the packaging line 30.

The system 10 also can use one or more sensors 52, such as a grid sensor, to detect the presence of a container 32 at the dunnage dispensing means 14 or packing station. If a container is detected, then the controller 24 can control the packaging line 30 to prevent another container from entering a pack zone at the dunnage dispensing means 14. Information from the sensors 52 also can be used to control the speed of dunnage output by the dunnage dispenser 14.

Accordingly, the present invention also provides a method of dispensing dunnage to a container as a function of a measured void volume. The method includes the step of dispensing dunnage at a first speed, monitoring the void volume of a container, and dispensing dunnage at a second speed different from the first speed based on the relationship between the void volume and a predetermined value. Accordingly, the first speed can be less than the second speed, and dunnage can be dispensed at the second speed whenever the void volume is greater than and/or equal to a predetermined value.

In summary, the present invention provides an improved packaging system that includes a packaging line that guides containers in a downstream direction, a sensor that can identify a dimension of a container on the packaging line, a dunnage dispenser on the packaging line downstream of the sensor to dispense dunnage to a void volume in a container, and a container closer downstream of the dunnage dispenser to close containers on the packaging line downstream of the dunnage dispenser. The container closer includes an adjustable member, and is in communication with the sensor to adjust the adjustable member based on the identified dimension of the container. The system thus includes a way to identify the size of the container before the container reaches the container closer. The container closer can adjust for the container's size before the container arrives, speeding up the container closing operation.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A packaging system, comprising:

a packaging line that guides containers in a downstream direction;

a sensor that can identify a height dimension of a container on the packaging line;

a dunnage dispenser on the packaging line downstream of the sensor to dispense dunnage to a void volume in a container; and a container closer downstream of the dunnage dispenser to close a container on the packaging line downstream of the dunnage dispenser;

where the container closer includes an adjustable member, the container closer being in communication with the sensor that is upstream of the dunnage dispenser to adjust the adjustable member based on the identified height dimension of the container before the container arrives at the container closer.

2. A system as set forth in claim 1, where the dunnage dispenser is at a dunnage dispensing station along the packaging line, and the dunnage dispenser converts a stock material into a dunnage product having a lower density than the stock material.

3. A system as set forth in claim 1, where the dunnage dispenser converts a sheet stock material into a dunnage product having a lower density than the stock material.

4. A system as set forth in claim 1, where the dunnage dispenser includes a supply of sheet stock material.

5. A system as set forth in claim 1, where the height dimension identified by the sensor is used to determine a void volume in the container.

6. A system as set forth in claim 1, where the dunnage dispenser is in communication with the sensor and dispenses a volume of dunnage based on the identified height dimension of the container.

7. A system as set forth in claim 1, where the container closer includes a height-adjustable member.

8. A system as set forth in claim 1, where the packaging line includes a conveyor.

9. A system as set forth in claim 1, where the container closer includes a tape applicator to seal containers closed.

10. A packaging method, comprising the following steps:

identifying a height dimension of a container;

dispensing dunnage into the container at a dunnage dispensing station after the identifying step;

adjusting a container closer after the identifying step based on the identified height dimension;

moving a container from the dunnage dispensing station to a container closing station spaced from the dunnage dispensing station; and closing the container with the container closer after the dispensing step and adjusting step at the closing station;

wherein the adjusting step occurs before the container arrives at the closing station.

11. A method as set forth in claim 10, where the identifying step includes using the sensed height dimension of a container to determine a container height from a database of container heights.

12. A method as set forth in claim 10, where the adjusting step includes adjusting a height of a movable member of the container closer.

* * * * *